United States Patent [19]

Worthington

[11] Patent Number: 4,960,355

[45] Date of Patent: Oct. 2, 1990

[54] APPARATUS FOR TRANSFERRING REFUSE FROM CONTAINERS INTO REFUSE EQUIPMENT

[75] Inventor: Stanley W. Worthington, Waterloo, Iowa

[73] Assignee: Waste Management of North America, Inc., Oak Brook, Ill.

[21] Appl. No.: 297,031

[22] Filed: Jan. 17, 1989

[51] Int. Cl.[5] ..... B65F 3/00

[52] U.S. Cl. ..... 414/408; 414/422

[58] Field of Search ..... 414/408, 409, 421, 422

[56] References Cited

U.S. PATENT DOCUMENTS

| | | | |
|---|---|---|---|
| 3,702,662 | 11/1972 | Davieau | 414/422 X |
| 4,479,751 | 10/1984 | Wyman et al. | 414/421 X |
| 4,773,812 | 9/1988 | Bayne et al. | 414/408 |

FOREIGN PATENT DOCUMENTS

| | | | |
|---|---|---|---|
| 1201756 | 9/1965 | Fed. Rep. of Germany | 414/408 |

*Primary Examiner*—Joseph J. Rolla
*Assistant Examiner*—Keith L. Dixon
*Attorney, Agent, or Firm*—Ellsworth R. Roston; Charles H. Schwartz

[57] ABSTRACT

An inverter apparatus of the type which may be used on a truck or other vehicle for inverting containers such as refuse containers for dumping their contents into a chamber within the vehicle. The apparatus uses a pair of cylinders having retractable rods which act through torque members to sequentially rotate a pair of pin carrier arms and inverter bars to invert a container having a pair of laterally extending pins. During rotation of the inverter bars the pins are always locked between the pin carrier arms and guide brackets attached to the truck body. The present invention provides a unique container and inverting apparatus interlock feature which is in effect at all times that the container is more than a few inches above the ground, thus rendering it virtually impossible during the inverting process to inadvertently drop or swing the container.

26 Claims, 5 Drawing Sheets

APPARATUS FOR TRANSFERRING REFUSE FROM CONTAINERS INTO REFUSE EQUIPMENT

BACKGROUND OF THE INVENTION

1. Field of the Invention

The present invention relates generally to an apparatus for inverting a container such as that which may be mounted on a refuse collection vehicle for inverting and dumping the contents into a chamber within the vehicle and, more specifically, to such an inverting apparatus which cooperates with a pair of pins extending from the container for locking the pins during the inverting process to enhance the safety of the inverting operation.

2. Prior Art

The simple process of inverting a container, such as for dumping the contents thereof into a receptacle, can be very difficult, if not impossible, to accomplish manually, particularly when the containers are large and cumbersome. Manually inverting a container such as for the purpose of emptying refuse or other material within the container into a receptacle such as the chamber of a refuse truck, for example, can become virtually impossible to do manually when the weight of the container is greater than the weight which one or two persons can easily handle. This problem is further exacerbated, when it must be repeated often, such as in the case of widely distributed refuse containers being inverted for dumping their contents into the chamber of a refuse collection vehicle. While it has become expedient for both user and collector to utilize large containers, such as those having a capacity up to two cubic yards, inverting such large containers has made the development of machines for carrying out the inverting process, virtually mandatory. Where such machines are used on vehicles, such as in the case of refuse collection trucks, and the like, they must be capable of easily and repetitiously handling such containers in an expedient and efficient manner, without adding substantially to the weight and cost of the vehicle. Furthermore, such machines, particularly those that are mounted on vehicles for purposes of collecting refuse for example, must be capable of operating with relatively simple container structures so as not to require complex and costly containers which also add to the cost of the refuse collection process. Still another critical requirement for such container inverting machines is that of safety. Safety is of particular concern in those cases where a large, heavy container is being both inverted and elevated simultaneously in order to bring the open top of the container its communication with a receiving chamber, such as the interior of a refuse collection truck. If a container is dropped during the process of inverting and elevating it, it could result in serious bodily injury and property damage including damage to the collecting vehicle and the container itself.

While there have been a number of prior art container inverting systems developed for the refuse collection industry, all those known to the applicant herein suffer from one or more disadvantages. Thus, for example, some of such prior art inverting systems are too complex, and thus too costly. Others suffer from the disadvantage of being too slow and inefficient, thereby also increasing the cost of the overall refuse collection effort. Some, for example, require that the vehicle be maneuvered into a special position relative to the container in order to initiate a container grasping or hooking function before the inverting operation can commence. Others require the use of more than one person to compensate for the inadequacies of the inverting machine. Such a requirement for additional personnel also significantly increases the cost of the collection process. However, the most significant disadvantage of the prior art, particularly in regard to rear vehicle-mounted inverting systems, is the lack of a positive interlocking relationship between the inverting system and the container during the inverting process. Such prior art systems thus do not adequately alleviate the critical safety concerns previously described.

There has therefore been a long-felt need for a container inverting apparatus which solves the previously noted deficiencies of the prior art. More specifically, there is in particular a need for a container inverting apparatus that may be readily utilized on a vehicle such as a refuse collection vehicle and which is of simple and low cost structure, which can be easily operated by one person in an efficient manner, which does not require exotic and therefore expensive container structures and which, perhaps most importantly, provides a positive safety interlock between container and inverting apparatus any time a container is more than a few inches above the ground, thereby precluding virtually any possibility of a falling or swinging container that might otherwise result in injury or property damage.

SUMMARY OF THE INVENTION

The present invention comprises a container inverting system which meets the aforementioned long felt need. More specifically, the present invention, which is particularly suitable for use on vehicles such as for the purpose of inverting refuse containers for dumping their contents into the interior chamber of a refuse collection vehicle, provides a simple low cost structure adapted to operate with relatively standard containers having only slight modification Furthermore, the container inverting apparatus of the present invention, obviates any requirement for manual lifting of the container and also obviates any requirement for special maneuvering of the collection vehicle relative to the container. Most importantly however, the present invention provides a unique container and inverting apparatus interlock feature which is in effect at all times that the container is more than a few inches above the ground, thus rendering it virtually impossible during the inverting process to inadvertently drop or swing the container.

A preferred embodiment of the invention is implemented using a pair of hydraulic or pneumatic cylinders, the retractable rods of which are each attached to a pair of torque members. One such torque member is rotatably attached to a carrier arm which provides a hook portion which receives a pin extending from a container. The other torque member is attached to an inverter bar which is designed to apply a rotating force to a surface of the container. Each such cylinder and rod is associated with a guide bracket having a pin stop which cooperates with the hook portion of the carrier arm to positively lock the pins extending from the container. The unique operation of the torque members in response to retraction and subsequent extension of the rods, produces two discrete sequential motions. When the container is being inverted for dumping the contents thereof, the first such discrete motion is that of tilting and lifting an upper edge of the container until the aforementioned container pins are in positive locking engagement with the carrier arms and the pin stop portion of the guide brackets. Once this locking interaction becomes effective for securing the container, the second discrete motion is then initiated. The inverter bars then apply an elevationally directed force to the surface of the container resulting in rotation of the entire container about the pins extending therefrom through an angle of approximately 170 degrees. This second discrete motion places the open top of the container in communication with a suitable receptacle such as the refuse chamber of a refuse collection vehicle to which the inverter apparatus of the present invention may be attached. After the container is emptied by the effect of gravity, these sequential motions are reversed by extension of the rods. The container is rotated back to its normal upright configuration, all the while remaining locked at its pins to preclude any possibility of being dropped or swinging out of control. Only when the container has been rotated almost to its upright position and the bottom of the container is only a short distance from the ground, is the positive locking engagement released. However, even during this period of time, the pins of the container remain in contact with and in control of the hook portions of the carrier arms thereby precluding any safety hazard.

OBJECTS OF THE INVENTION

It is therefore a principal object of the present invention to provide a container inverting apparatus which substantially reduces or entirely overcomes the noted deficiencies of the prior art.

It is a further object of the present invention to provide a container inverting apparatus which utilizes positive interlocking engagement between the apparatus and the container to preclude dropping or losing control of the container during the inverting process.

It is still a further object of the present invention to provide a container inverting apparatus of the type which may be attached to a vehicle such as a refuse collection vehicle for the purpose of dumping refuse containers into a chamber within the vehicle wherein the apparatus is of simple, low cost structure which obviates any requirement for manually lifting the container while utilizing a simple pin extension on each side of the top container.

It is still an additional object of the present invention to provide a container inverting apparatus which utilizes a positive locking arrangement for preventing dropping or losing control of the container and which utilizes a pair of discrete sequential motions for tilting the container, the first such motion securing the locking engagement of the container with the apparatus before the second such motion completely inverts the container for dumping the contents thereof.

BRIEF DESCRIPTION OF THE DRAWINGS

The aforementioned objects and advantages of the invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
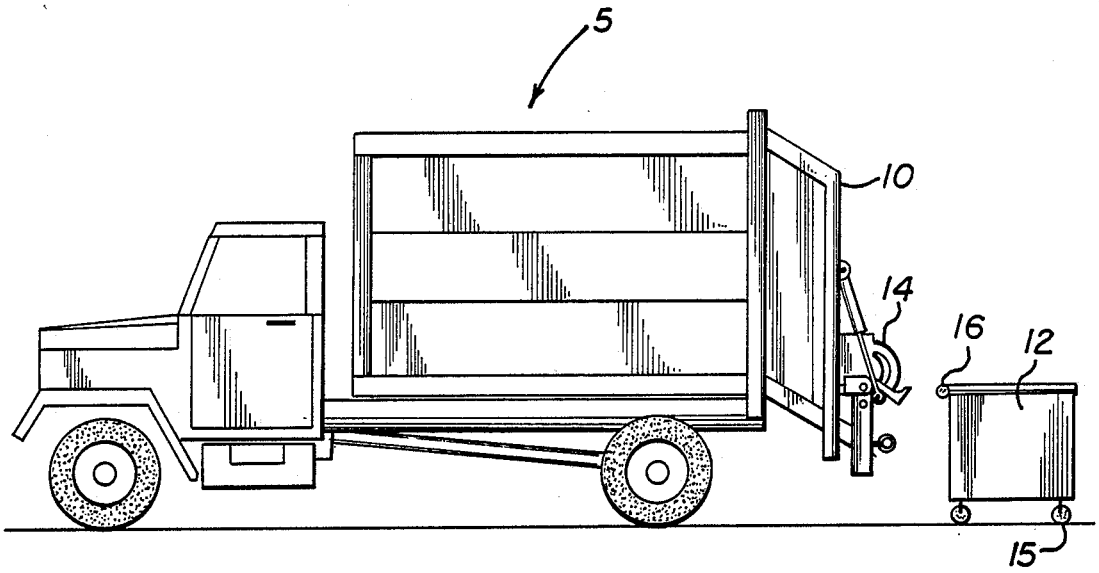
FIG. 1 is a side view of a vehicle and container with which the present invention may be used.

Referring now to FIGS. 1 through 4 it will be seen that a preferred embodiment of the present invention is implemented as an inverting apparatus for use on a vehicle such as a refuse collection vehicle wherein the invention is mounted to the rear portion of the vehicle for inverting refuse containers. Such inverting dumps the contents of containers into a chamber or receptacle within the vehicle wherein the chamber is accessible at the rear of the vehicle. More specifically, as seen in FIG. 1, the present invention may be employed on a vehicle such as a refuse collection truck 5, which provides a truck body 10 which is adapted to receive the contents of a large plurality of containers such as container 12. Each such container 12 for use with the preferred embodiment of the invention shown herein, may be of up to two cubic yards in capacity and may be readily transported a short distance to the rear portion of the vehicle 5 such as by rolling the container on wheels 15 toward the inverter apparatus 14.

Figure 2:
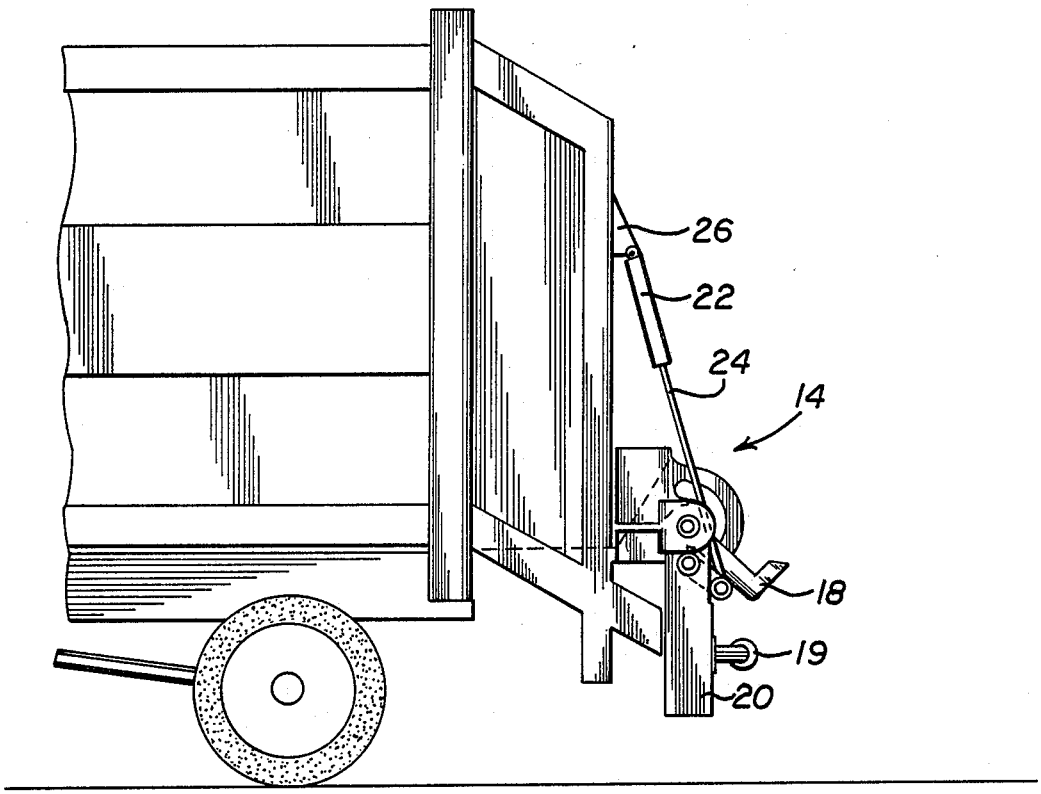
FIG. 2 is an enlarged view of the rear portion of the vehicle illustrating one example of the relative placement of the apparatus on the vehicle.
Figure 3:
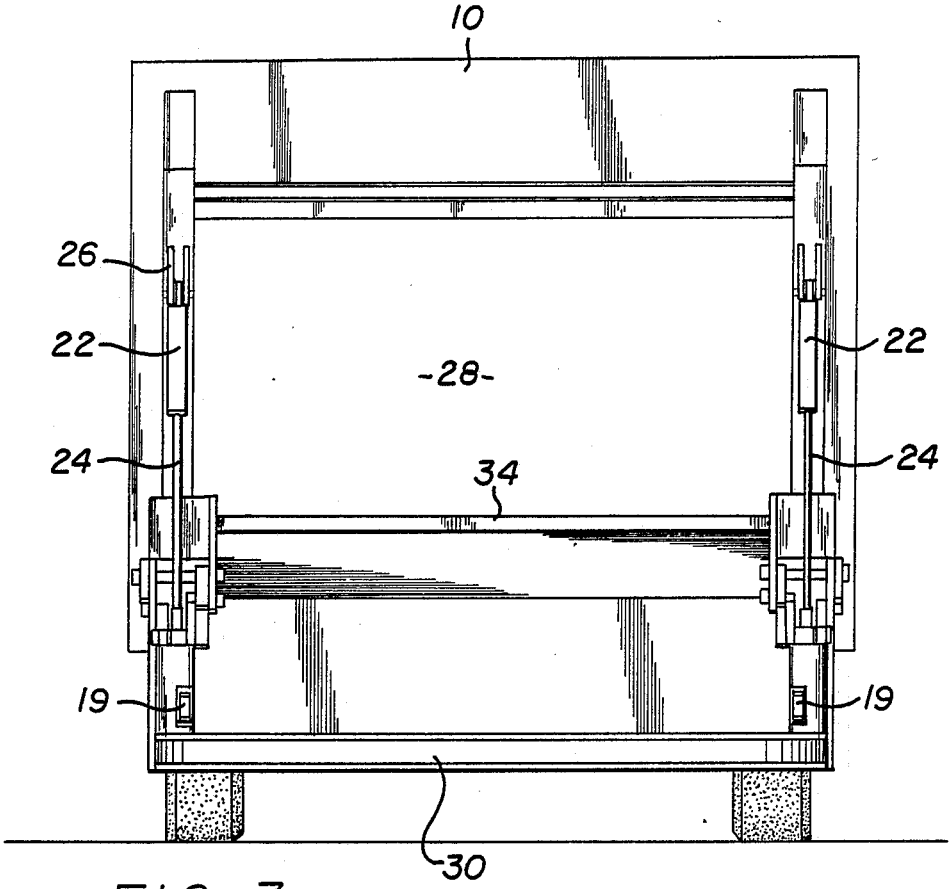
FIG. 3 is a rear view of the vehicle of FIGS. 1 and 2 illustrating the position of the apparatus of the present invention thereon.

As seen generally in FIGS. 2 and 3, inverter apparatus 14 comprises a pair of pin carrier arms 18 and a pair of inverter bars 20 which constitute the principal elements of the invention for inverting container 12 for dumping its contents into the truck body 10. The motion of pin carrier arms 18 and inverter bars 20 is controlled by a cylinder 22 which may for example, be either a hydraulic cylinder or a pneumatic cylinder and which comprises a retractable rod 24. Retraction of rod 24 produces counterclockwise rotation of the pin carrier arms 18 and the inverter bars 20 (as viewed in FIG. 2) for inverting the container 12. Extension of rod 24 produces the opposite motion, namely, clockwise rotation of pin carrier arms 18 and inverter bars 20 for reorienting the emptied container 12. The cylinder 22 is secured to the truck body 10 by means of a retaining bracket 26. Each of the inverter bars 20 is provided with a wheel 19 which is adapted to contact a surface of the container 12 for smooth translation of the container during the inverting process.

As seen best in FIG. 3, the inverting apparatus 14 of the present invention comprises two substantially identical sets of pin carrier arms, inverter bars and cylinders which are connected to the rear of truck body 10 on opposed sides of the opening to a chamber 28 within the truck body. Aside from their common connection to the rear face of truck body 10, the only interconnections between the two sets of members comprising the inverting apparatus 14 are a synchronizing torsion bar 30 and a structural member 34.

Figure 4:
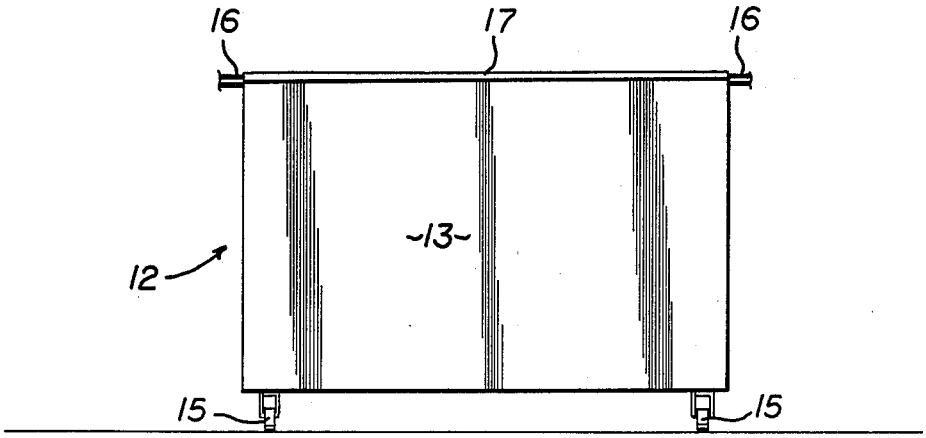
FIG. 4 is an elevational view of a container with which the present invention may be used.

While the inverting apparatus of the present invention is designed to operate with containers of a particular configuration, it will be seen in FIG. 4 that this configuration constitutes a relatively minor modification of standard rectangular containers of sizes up to about 2 cubic yards in capacity. More specifically, referring to FIG. 4 it will be seen that container 12 is of a rather simple standard rectangular configuration except for a pair of laterally extending pins 16. These pins extend about six inches from the sides of the container 12 and are positioned at about the intersection of the interfacing surface 13 and the open top plane 17. Interfacing surface 13 is that surface of the container 12 which is designed to engage the wheels 19 attached to the respective inverter bars 20 of the inverter apparatus 14.

Figure 5:
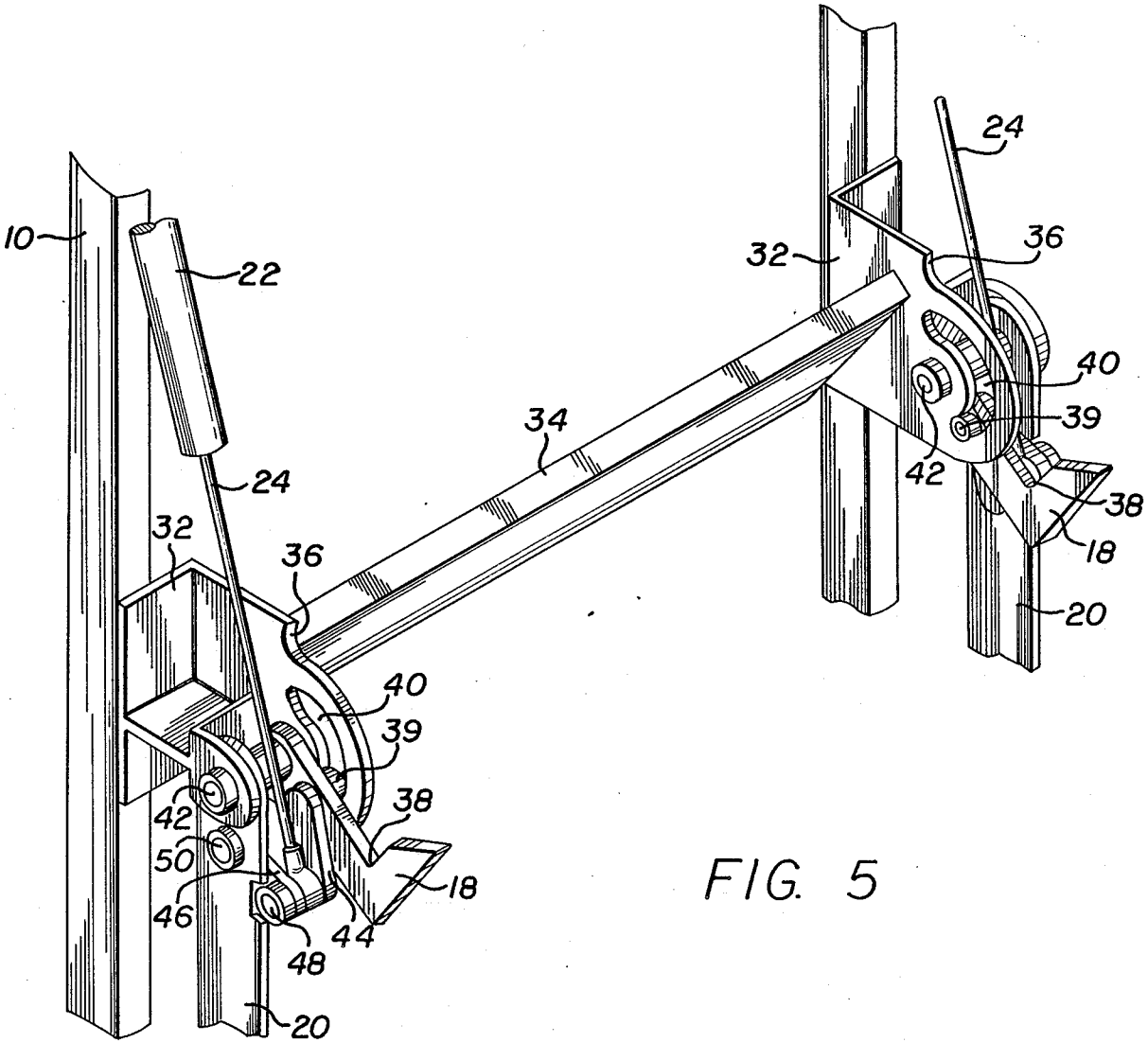
FIG. 5 is an enlarged isometric view of the container locking portion of the present invention.

The detailed structure of the inverter apparatus 14 may be best understood by referring to FIG. 5 wherein it is seen that the apparatus comprises a pair of guide brackets 32 preferrably interconnected by a structural member 34. Guide brackets 32, which are identical except for being configured as mirror images of each other, serve a number of functions. One such function is rotatably engaging pin carrier arms 18 and inverter bars 20 by means of respective arm axles 42. Another such function is guiding the rotational motion of the pin carrier arms 18 by means of curved grooves 40 each of which carries a guide bushing 39. Bushing 39 is also secured to the pin carrier arm 18 at a point displaced from axle 42. Still another such function is to providing a pin stop 36 which cooperates with a pin hook 38 in the carrier arm 18 for locking the pin 16 of the container. Such locking firmly secures the container during the majority of its inverting motion and provides a stable axis of rotation about which the container is inverted by inverter bars 20 in the manner to be described hereinafter.

The end of each cylinder rod 24 is attached to a pair of torque members, namely torque member 44 and torque member 46. Torque member 44 is attached to the pin carrier arm 18 through which it is secured to the guide bushing 39 resting in curved groove 40. Torque member 46 is attached to inverter bar 20 by means of a bushing 50 at a point displaced from arm axle 42. The two torque members 44 and 46 and the end of cylinder rod 24 are secured to one another by means of a torque member axle 48. It is through torque members 44 and 46 that the cylinder rod 24 acts to rotate pin carrier arm 18 and inverter bar 20 to invert the container 12. Furthermore, because of the unique arrangement and interaction of torque members 44 and 46 with their associated pin carrier arm and inverter bar, the rotation of pin carrier arm 18 and inverter bar 20 is always sequential. More specifically, the rotation of the carrier arms always occurs first during the inverting sequence and last during the reorientation sequence for implementing the unique positive locking feature of the invention as will be described herein in more detail in conjunction with FIGS. 6 through 9.

Figure 7:
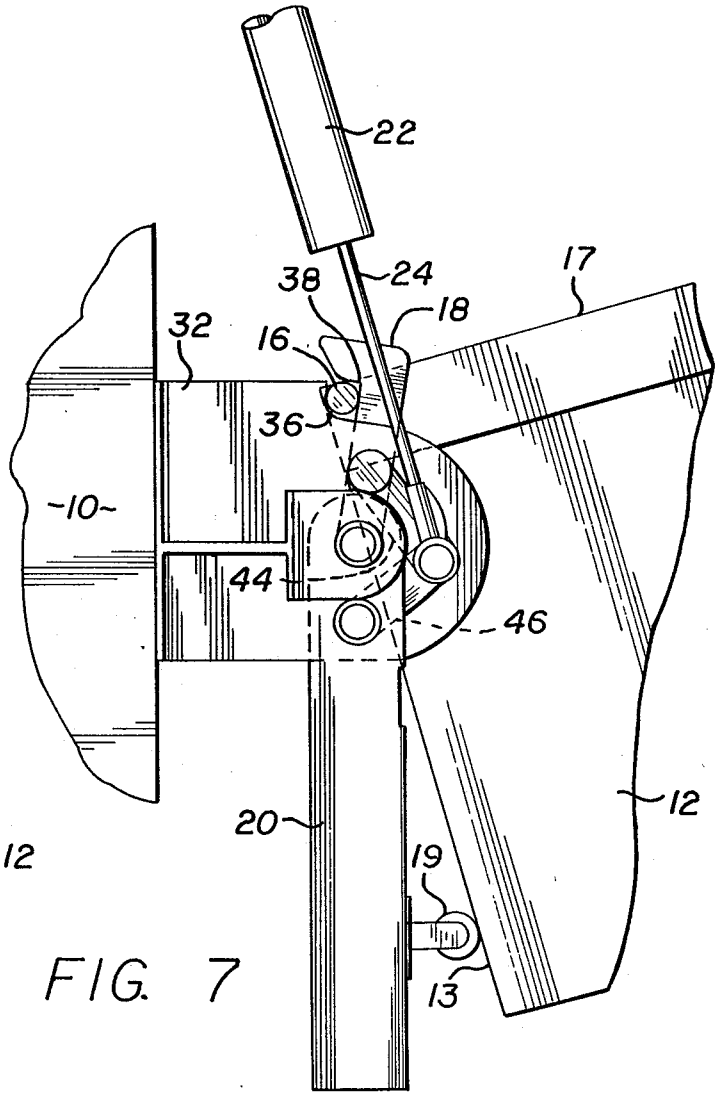
FIG. 6 through 9 provide sequential side elevational views of the present invention showing the operation thereof for inverting a container.
Figure 6:
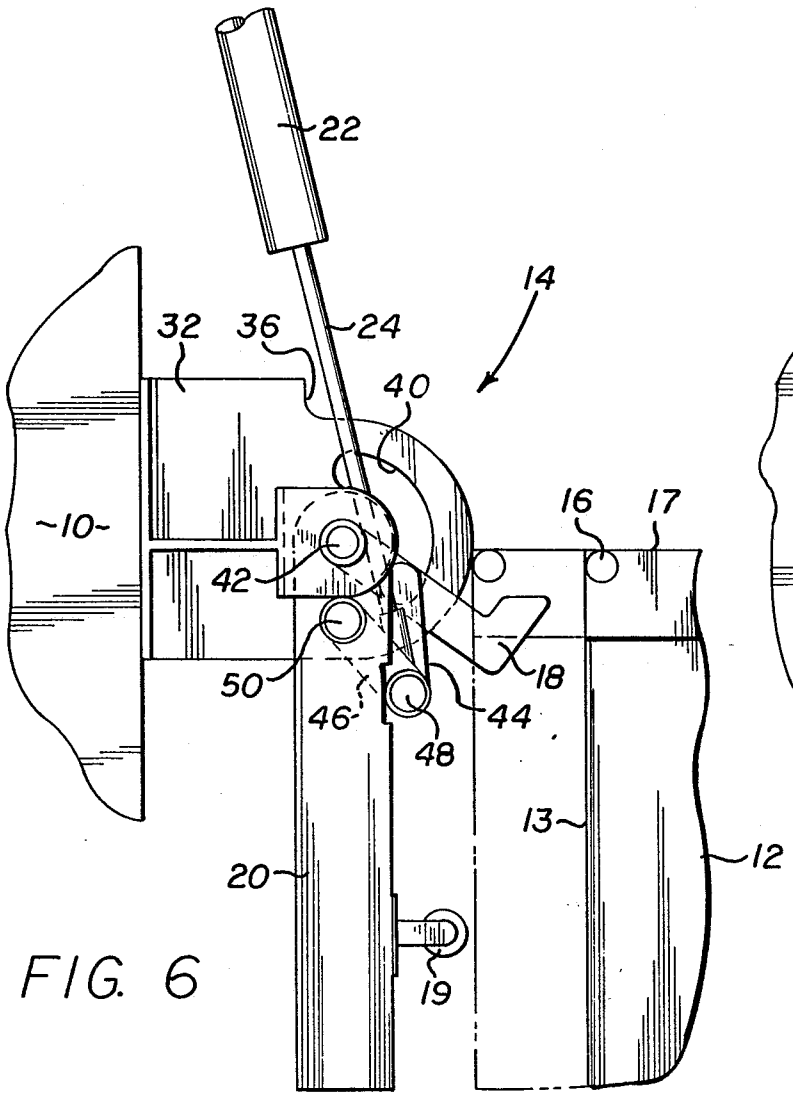

As seen in FIG. 6, when container 12 is initially disposed in juxtaposed relation to inverter apparatus 14, cylinder rod 24 is fully extended. A fully extended rod places pin carrier arm 18 in its lower-most position immediately beneath pin 16 and inverter bar 20 in its lowest-most position which is substantially vertical and in contact with a portion of the truck body 10 as may be seen in FIG. 2. Referring to FIG. 7, it will be seen that when the cylinder rod 24 begins to retract, it both rotates and translates torque member 44, but only rotates torque member 46. As a result, only pin carrier arm 18 is rotated and inverter bar 20 remains fixed in its vertical position. As pin carrier arm 18 rotates in a counterclockwise direction (as viewed in FIG. 7), it engages pin 16 of container 12 at pin hook 38, thereby both tilting and raising container 12 until pin 16 engages pin stop 36 of guide bracket 32. At this point in the inverting process, wheel 19 of inverter bar 20 engages surface 13 of container 12, thus providing a moment for tilting container 12 about pin 16. Furthermore, it will be seen in FIG. 7 that at this point in the sequence, torque member 44 can no longer be translated and that further retraction of cylinder rod 24 will produce only rotation in torque member 44 while producing both rotation and translation of torque member 46.

Figure 9:
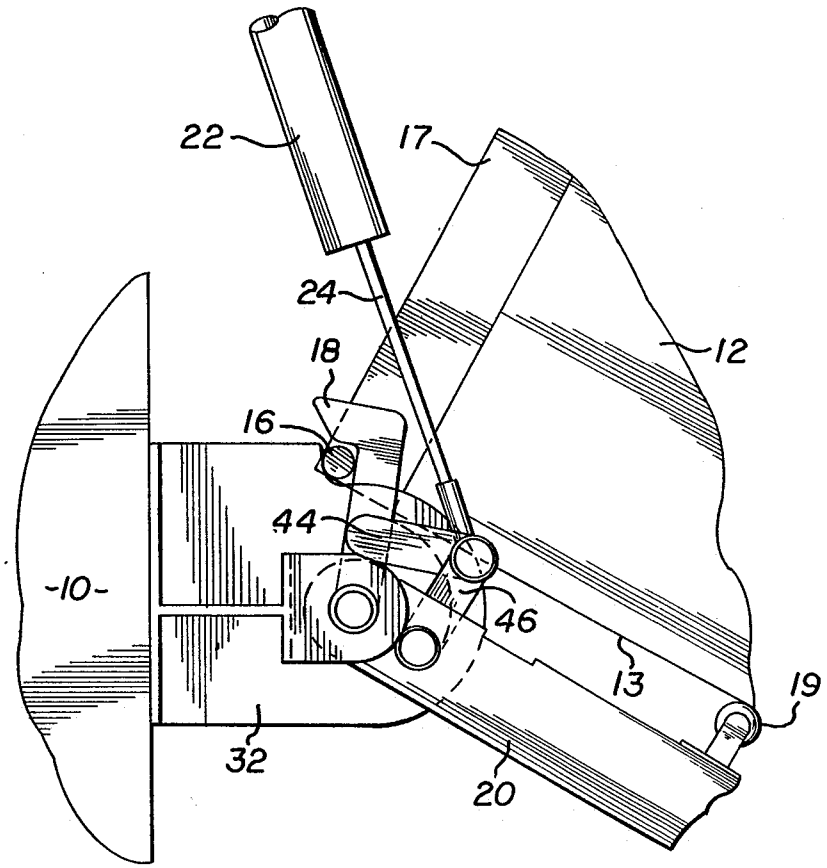
Figure 8:
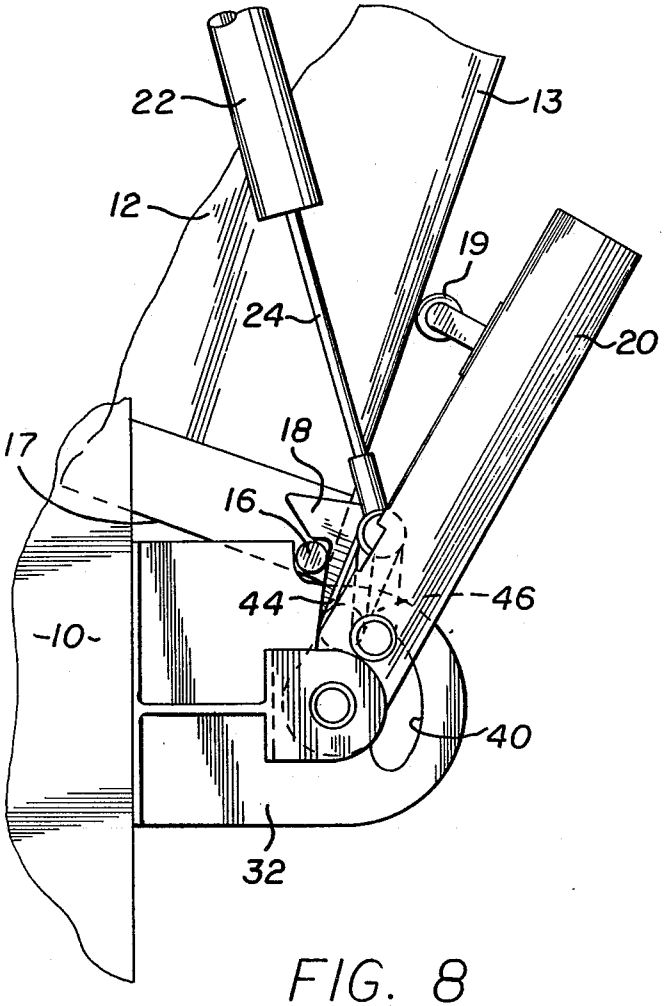

As seen in FIG. 8, continued retraction of cylinder rod 24 and the resulting translation of torque member 46 produce a rotation of inverter bar 20 while pin 16 of the container remains fixed except for its rotation between pin hook 38 of arm 18 and pin stop 36 of bracket 32. This rotation of container 12 about the axis formed through pins 16 results in inversion of the container which brings the top plane 17 of the container beneath the container, thereby allowing the contents thereof to fall into the chamber 28 of the truck body 10. It will be noted that because of the interaction and operation of the torque members 44 and 46 during the inverting process, rotation of carrier arm 18 and inverter bar 20 is sequential without overlap and as a result pin 16 is locked during the entire rotational motion of inverter bar 20. After the contents of container 12 are dumped, cylinder rod 24 is released by cylinder 22 allowing the weight of container 12 on inverter bar 20 to extend rod 24. In this configuration, there is tension on both cylinder rod 24 and on torque member 46. The combination of these tension forces places torque member 44 in a state of compression. Such compression applies a counter-rotationally directed torque on carrier arm 18 thereby continuing to lock pin 16 until inverter bar 20 has rotated back to its original vertical position in contact with truck body 10 as shown in FIG. 9 and until the container is returned to the configuration corresponding to FIG. 7. As soon as inverter bar 20 contacts the truck body 10, the weight of container 12 can no longer cause translation of torque member 46. This configuration produces a clockwise-directed torque on carrier arm 18 and torque member 44 which results in a clockwise rotation of arm 18 thereby permitting container 12 to return to its original upright position shown in phantom in FIG. 6 with cylinder rod 24 being fully extended.

Thus, it will be observed that the motion of pin carrier arms 18 and inverter bars 20 for inverting and then reorienting container 12, is always sequential whereby to lock pin 16 at all times during which inverter bars 20 are elevated from their vertical position in contact with the truck body 10. As a result, there is no way in which the inverter apparatus of the present invention will permit the container to be dropped while the container is substantially above the ground and in its inverted or partially inverted configuration. Consequently, the present invention provides a unique safety feature which is particularly advantageous for preventing any substantial injury or property damage during the inverting process.

It will now be understood that what has been disclosed herein comprises a novel inverter apparatus of the type which may be used on a truck or other vehicle for inverting containers such as refuse containers for dumping their contents into a chamber within the vehicle. The apparatus uses a pair of cylinders having retractable rods which act through torque members to sequentially rotate a pair of pin carrier arms and inverter bars to invert a container having a pair of laterally extending pins. During rotation of the inverter bars the pins are always locked between the pin carrier arms and guide brackets attached to the truck body. Despite the highly advantageous safety feature of the invention, the structure thereof is of simple and low cost configuration which can be easily operated by one person and which does not require the maneuvering of the vehicle to specially align the vehicle with the container.

Those having skill in the art to which the present invention pertains will, as a result of the applicant's teaching herein, now perceive various modifications and additions which may be made to the invention. By way of example, while a preferred embodiment of the inverting apparatus of the present invention has been shown attached to a vehicle such as a refuse collection truck, it will be understood that invention may also find highly advantageous use in a stationary application where no transportability is required. Furthermore, while specific shapes and interconnection of various members of the apparatus have been disclosed herein, it will be understood that alternatives in both shape and interconnection may be readily adapted for use in the apparatus disclosed herein. In some applications, it may be desireable to employ only one centrally positioned container pin or only one inverter bar. Accordingly, all such modifications and additions are deemed to be within the scope of the invention which is to be limited only by the claims appended hereto.

I claim:

1. A container apparatus for use with containers of the type having a pin extending from the container; the apparatus comprising:

means for selectively locking said pin in a fixed rotatable position relative to said apparatus, and means for rotating said container about said pin, with the pin locked in the fixed rotatable position, for inverting said container from an upright position while said pin is in locking engagement with said locking means, said rotating means being disposed in a fixed position until said pin becomes locked in the fixed position relative to said apparatus and being thereafter operative to rotate said container about said pin for inverting said container.

2. The container inverting apparatus recited in claim 1 further comprising means for activating said locking means for producing said locking engagement with said pin before activating said rotating means for rotating said container about said pin to invert said container.

3. The container inverting apparatus recited in claim 2 wherein said activating means prevents disengagement of said locking means from the fixed rotatable position, during re-orientation of the inverted container to an upright position, until after said rotating means has re-oriented said inverted container to the upright position.

4. The container inverting apparatus recited in claim 1 wherein said locking means comprises a hook-shaped pin carrier arm for engaging a first peripheral surface of said pin and a pin stop for engaging a second opposing peripheral surface of said pin.

5. The container inverting apparatus recited in claim 1 wherein said rotating means comprises a rotatable bar positioned for engaging a surface of said container at a location displaced from said pin.

6. A container inverting apparatus for use with containers of the type having a pin extending from the container; the apparatus comprising:

means for selectively locking said pin in a fixed rotatable position relative said apparatus; and means for rotating said container about said pin for inverting said container while said pin is in locking engagement with said locking means wherein said activating means comprises a retractable member and a pair of torque members, said retractable member being rotatable connected to first ends of said torque members along a common axis, a second end of one said torque member being rotatably connected to said locking means and a second end of the other said torque member being rotatably connected to said rotating means.

7. A container inverting apparatus for use with a container having a graspable pin, the apparatus comprising:

a hook arm for engaging a first portion of said pin;

a pin stop for engaging a second portion of said pin, said first and second pin portions being on opposed peripheral surfaces of said pin;

means for moving the hook arm to a position where the first portion of the pin is locked by the pin arm and the second portion of the pin is locked by the pin stop;

a container-engaging member disposed for swinging said container about said pin through a pre-determined angle;

said container engaging member being disposed in a fixed position until said pin is locked by the pin arm and the pin stop a torque-imparting device connected to said hook arm and to said container-engaging member for imparting angular elevation thereto for selectively inverting and re-orienting said container, and means operative upon the locking of said pin by said hook arm and said pin stop for operating upon said torque-imparting device to obtain a selective inverting and reorienting of said container.

8. A container inverting apparatus for use with a container having a graspable pin, the apparatus comprising:

a hook arm for engaging a first portion of said pin;

a pin stop for engaging a second portion of said pin, said first and second pin portions being on opposed peripheral surfaces of said pin;

a container-engaging member disposed for swinging said container about said pin through a pre-determined angle;

a torque-imparting device connected to said hook arm and to said container-engaging member for imparting angular elevation thereto for selectively inverting and re-orienting said container wherein said torque-imparting device comprises a linearly retractable rod and a pair of torque members, said rod and a first end of each said torque member being interconnected at a common axis, a second end of one of said torque members being connected to said hook arm and a second end of the other of said torque members being connected to said container-engaging member.

9. The container inverting apparatus recited in claim 8 wherein said torque members are disposed for producing a non-concurrent sequential motion of said hook arm and said container-engaging member for locking said pin between said hook arm and said pin stop while said container is being swung about said pin by said container-engaging member.

10. In combination with a refuse collection vehicle, an apparatus for inverting a refuse container for emptying the contents of the container into a chamber within the vehicle, the container of the type having a pin extending laterally along a common axis from two opposing sides of the container, the apparatus being attached to the vehicle adjacent an entrance to the chamber, the apparatus comprising:

two spaced-apart hook arms disposed on respective opposed portions of said vehicle adjacent said chamber entrance for engaging said container pins upon angular travel about an axis;

a pin stop associated with each said hook arm and disposed in relation to the associated hook arm for locking a respective one of said pins between said pin stop and each said hook arm during inversion of said container;

an inverting bar disposed for swinging said container about said pin axis as a fulcrum through a predetermined angle; and means for imparting angular motion to said hook arms for moving the container pins into engagement with said pin stops; and means responsive to the locking of said container pins in fixed position relative to said pin stops for subsequently moving said inverter bar to swing said container about said pin axis as a fulcrum through said pre-determined angle.

11. In combination with a refuse collection vehicle, an apparatus for inverting a refuse container for emptying the contents of the container into a chamber within the vehicle, the container of the type having a pin extending laterally along a common axis from two opposing sides of the container, the apparatus being attached to the vehicle adjacent an entrance to the chamber; the apparatus comprising:

two spaced-apart hook arms disposed on respective opposed portions of said vehicle adjacent said chamber entrance for engaging said container pins upon angular travel about an axis;

a pin stop associated with each said hook arm and disposed in relation to the associated hook arm for locking a respective one of said pins during inversion of said container;

an inverting bar disposed for swinging said container about said pin axis through a pre-determined angle; and means for imparting angular motion to said hook arms and to said inverting bar for inverting said container wherein said angular motion imparting means comprises two linearly retractable rods and two sets of first and second torque members, each said rod and each said set of first and second torque members being interconnected at a common axis, each said first torque member also being connected to a respective one of said hook arms at a point displaced from said hook arm axis and at least one of said second torque members also being connected to said inverting bar.

12. The apparatus recited in claim 11 wherein said sets of first and second torque members are respectively disposed relative to said hook arms and to said inverting bar for producing a first motion of said hook arms to lock said pins and a non-current second motion of said inverter bar to invert said container.

13. In combination for use with a container having a graspable pin to transfer refuse in the container into refuse equipment.

first means for engaging the pin, the first means being pivotable, hydraulic drive means having expansible and retractible states of operation for the first means to engage and move the pin, second means co-operative with the first means and responsive to the movement of the first means and the pin for fixedly locking the pin to secure the container, third means responsive to an initial retraction of the hydraulic drive means for pivoting the first means into the co-operative relationship with the second means for fixedly locking the pin to secure the container, and fourth means responsive to the locking of the pin by the co-operative relationship between the first and second means and responsive to the continued retraction of the hydraulic drive means for subsequently pivoting the container, with the pin fixedly locked by the cooperative relationship between the first means and the second means, to a position for the transfer of the refuse in the container into the refuse equipment.

14. In combination for use with a container having a graspable pin to transfer refuse in the container into refuse equipment.

first means for engaging the pin, the first means being pivotable, hydraulic drive means having expansible and retractible states of operation, second means co-operative with the first means for fixedly locking the pin to secure the container, third means responsive to the initial retraction of the hydraulic drive means for pivoting the first means into the co-operative relationship with the second means for fixedly locking the pin to secure the container, and fourth means responsive to the pivotal disposition of the third means in the co-operative relationship with the first means and responsive to the continued retraction of the hydraulic drive means for pivoting the container, with the pin fixedly locked, to a position for the transfer of the refuse in the container into the refuse equipment, the third means including a first torque member pivotable and translatable to provide for the pivoting of the first means into the co-operative relationship with the second means and the fourth means including a second torque member pivotable and translatable to provide for the rotation of the container, with the pin fixedly locked, to the position for the transfer of the refuse in the container into the refuse equipment.

15. In a combination as set forth in claim 13, the container having a side wall, the third means including an inverter bar pivotable into engagement with the side wall of the container for pivoting the container to the position for transfer of the refuse in the container into the refuse equipment and the first means including a carrier arm pivotable into the position where the pin becomes fixedly locked by the first means and the second means.

16. In a combination as set forth in claim 14, wherein the first torque member is disposed to provide a compressive force during the pivotable movement of the first means into the co-operative relationship with the second means and wherein the second means is initially pivotable to pivot the container from the position for the transfer of the refuse in the container into the refuse equipment and wherein the second means is disposed to provide a compressive force during the rotation of the container away from the position for the transfer of the refuse in the container into the refuse equipment and wherein the first means is subsequently pivotable out of the co-operative relationship with the second means.

17. In combination for use with a container having a graspable pin to transfer refuse in the container into refuse equipment, a pivotable carrier arm for supporting the container, first means for receiving the graspable pin on the container and for pivoting the carrier arm to provide a pivotal movement of the container, second means disposed in co-operative relationship with the first means after a particular pivotal movement of the carrier arm for co-operating with the first means to lock the pin in a fixed position, and third means responsive to the co-operative relationship between the first means and the second means for subsequently providing a pivotal movement of the container upwardly about the pin as a fulcrum to a position for the transfer of the refuse in the container into the refuse equipment.

18. In a combination as set forth in claim 17, means operative during the pivotal movement of the container by the third means for producing a force on the first means in a direction for maintaining the co-operative relationship between the first and second means to retain the pin in the fixedly locked position.

19. In a combination as set forth in claim 17, the first means including a torque member movable to provide for the pivotal movement of the carrier arm to obtain the co-operative relationship between the first means and the second means.

20. In a combination as set forth in claim 17, the third means including a torque member movable to obtain the pivotable movement of the container with the graspable pin as a fulcrum to the position for the transfer of the refuse in the container into the refuse equipment.

21. In a combination as set forth in claim 17, the first means including a first torque member pivotable and translatable to provide for the pivotal movement of the carrier arm to obtain the co-operative relationship between the first means and the second means, the third means including a second torque member pivotable and translatable for pivoting the container upwardly about the pin as a fulcrum to a position for the transfer of the refuse in the container into the refuse equipment, the first torque member being stationary during the pivotal and translational movements of the second torque member, the second torque member being stationary during the movements of the first torque member to provide for the particular movement of the carrier arm to the locking position of the pin.

22. In combination for use with a container having a graspable pin to transfer refuse in the container into the refuse equipment, first means for retaining the pin in a fixedly locked position with the container tilted upwardly to provide for the transfer of the refuse in the container into the refuse equipment, an inverter bar having a pivotable disposition, second means for pivoting the inverter bar and the container downwardly, with the pin as a fulcrum for the container, to a particular position for releasing the pin from the first means, the second means including means for insuring that the pin remains fixedly locked by the first means during the pivotal movement of the inverter bar and the container to the particular position, and third means responsive to the movement of the container downwardly to the particular position for moving and pivoting the container downwardly to the ground.

23. In a combination as set forth in claim 22, the insuring means in the second means including a torque member movable, during the operation of the second means in pivoting the inverter bar and container, with the pin fixed locked and serving as a fulcrum, in directions to insure that the pin remains fixedly locked by the first means during the pivotal movement of the inverter bar and the container.

24. In a combination as set forth in claim 22, the third means including a torque member movable in a direction to provide for the translation and the pivoting of the container downwardly to provide for the disposition of the container on the ground.

25. In a combination as set forth in claim 24, the insuring means in the second means including a second torque member movable, during the operation in pivoting the inverter bar and the container with the pin in locked position and serving as a fulcrum, in directions to insure that the pin remains fixedly locked by the first means during the pivotal movement of the container to the inverter bar.

26. In a combination as set forth in claim 25, the first and second torque members being disposed relative to each other and to the inverter bar to provide for the fixed locking of the pin by the first means during the pivotal movement of the inverter bar and the container downwardly and to provide for the release of the pin from such fixed locking by the first means after the pivotal movement of the inverter bar and the container to obtain a subsequent translation and pivoting of the container downwardly to the ground.

* * * * *